US007543608B2

(12) United States Patent
Santens

(10) Patent No.: US 7,543,608 B2
(45) Date of Patent: Jun. 9, 2009

(54) LOOPED FABRIC COMPRISING BAMBOO LOOPS AND TERRY MADE THEREFROM

(75) Inventor: Frédéric Santens, Oudenaarde (BE)

(73) Assignee: Santens N.V., Oudenaarde (BE)

( * ) Notice: Subject to any disclaimer, the term of this patent is extended or adjusted under 35 U.S.C. 154(b) by 0 days.

(21) Appl. No.: 10/584,964

(22) PCT Filed: Jan. 6, 2005

(86) PCT No.: PCT/EP2005/000049

§ 371 (c)(1),
(2), (4) Date: Apr. 23, 2008

(87) PCT Pub. No.: WO2005/068697

PCT Pub. Date: Jul. 28, 2005

(65) Prior Publication Data

US 2008/0230140 A1 Sep. 25, 2008

(30) Foreign Application Priority Data

Jan. 9, 2004 (BE) ..... 2004/0013
Jun. 28, 2004 (BE) ..... 2004/0316

(51) Int. Cl.
*D03D 39/22* (2006.01)
*D03D 27/00* (2006.01)
*D03D 27/02* (2006.01)
*D03D 25/00* (2006.01)

(52) U.S. Cl. ..... 139/21; 139/383 R; 139/391; 139/395; 139/37; 139/116.5

(58) Field of Classification Search ..... 139/21, 139/37, 116.5, 383 R, 391–396
See application file for complete search history.

(56) References Cited

U.S. PATENT DOCUMENTS 2,376,983 A * 5/1945 Taylor et al. ..... 8/115.6
3,721,273 A * 3/1973 Sherrill et al. ..... 139/396
5,151,238 A * 9/1992 Earl et al. ..... 264/136
5,188,624 A * 2/1993 Young et al. ..... 604/378

(Continued)

FOREIGN PATENT DOCUMENTS

CN 1 414 156 4/2003

(Continued)

OTHER PUBLICATIONS

Download from China Bambro Textile Co., Ltd. website, 2003, http:\\web.archive.org/web/20031202021652/www.bambrotex.com/second/showroom_bath.htm.

(Continued)

*Primary Examiner*—Bobby H Muromoto, Jr.
(74) *Attorney, Agent, or Firm*—Knobbe, Martens, Olson & Bear, LLP

(57) ABSTRACT

A ground fabric made of cotton and provided with loops of bamboo fiber is used to form a looped fabric. The ground fabric has a ground weave that is obtained by a technique with three weft sequences or by a technique with four weft sequences. The looped fabric has a weight between 200 and 1700 gram/m$^2$. The number of warp threads per cm fabric is between 21 and 34, and the number of weft threads per cm fabric is between 10 and 28, and the number of loops per cm fabric is between 3 and 9. The looped fabric may be used as a terry.

23 Claims, 5 Drawing Sheets

U.S. PATENT DOCUMENTS

| | | | | |
|---|---|---|---|---|
| 5,980,673 | A * | 11/1999 | Takeuchi et al. | 156/183 |
| 6,309,731 | B1 * | 10/2001 | Takeuchi et al. | 428/154 |
| 6,720,057 | B1 * | 4/2004 | Neumayr et al. | 428/92 |
| 7,060,211 | B2 * | 6/2006 | Oda | 264/103 |
| 2002/0079014 | A1 * | 6/2002 | Hamby et al. | 139/396 |
| 2002/0098317 | A1 * | 7/2002 | Jaschinski et al. | 428/72 |
| 2002/0197445 | A1 * | 12/2002 | Eccles et al. | 428/97 |
| 2003/0056484 | A1 * | 3/2003 | Oda | 57/28 |
| 2003/0084954 | A1 * | 5/2003 | Hamby et al. | 139/396 |
| 2003/0092335 | A1 * | 5/2003 | Takaoka | 442/1 |
| 2004/0055659 | A1 * | 3/2004 | Hugh Silver | 139/396 |
| 2004/0131821 | A1 * | 7/2004 | Mandawewala | 428/97 |

FOREIGN PATENT DOCUMENTS

| | | |
|---|---|---|
| CN | 1 458 332 | 11/2003 |
| CN | 1 464 084 | 12/2003 |
| JP | 2001-115347 | 4/2001 |
| JP | 2003-328245 | 11/2003 |
| JP | 2004-162246 | 6/2004 |

OTHER PUBLICATIONS

International Search Report dated May 19, 2005.

* cited by examiner

LOOPED FABRIC COMPRISING BAMBOO LOOPS AND TERRY MADE THEREFROM

RELATED APPLICATIONS

This application is the U.S. National Phase under 35 U.S.C. § 371 of International Application PCT/EP2005/000049, filed Jan. 6, 2005 which claims priority to BE 2004/0013, filed Jan. 9, 2004 and BE 2004/0316, filed Jun. 28, 2004.

TECHNICAL FIELD

The present invention relates to a looped fabric and more in particular to a terry. The present invention also relates to the improvement of the technical and external appearance and characteristics of the obtained terry.

BACKGROUND OF THE INVENTION

According to the present prior art fabrics having loops, such as terry from which e.g. bath towels are made, consist of loops that are drawn from a supplementary warp thread or weft thread and fastened on the fabric or ground layer. In technical literature, such fabrics are also referred to as looped fabrics, whereby the loops are formed by the warp or the weft. Such fabrics are respectively also referred to as warp or weft looped fabrics.

The ground fabric consists in general of a woven underlayer. Weave of the ground fabric may comprise, but is not limited to, a plain weave, a panama weave or a twill weave. The loops are most frequently made of cotton or another fibre. Such fibres and the underlayer to which the loops are fastened, are not always biologically degradable. Besides cotton, other fibres of natural or synthetic origin are known. More specifically, with regard to terry, cotton fibres are preferably used.

The main characteristics of looped fabrics are determined by the loops which are generally, but not necessarily, provided on both sides of the ground fabric. The main purpose of such looped fabrics is their use as towel to dry the body. This implicates a great number of specific requirements, including good water absorption; a certain flexibility; an acceptable consistency of the loops; good stabilities: the towel should be resistant against washing at high temperatures, sunlight, etc. . . . ; the towels should satisfy certain dimensions that are requested by a customer.

Looped fabrics are most frequently applied as cloths such as towels, bathrobes, but recently also more as a technical fabric for example in the application as walking socks. Looped fabrics also have other applications such as for floor mats (heavy structure) for bathrooms as well as for clothing.

Not all terry has been woven, knitted terry is frequently employed in clothing. Also, in woven terry, the loops may be sheared or "wounded" by shearing. In such case, a rather fluffy surface or in the case of complete shearing of the loops, a real velvet surface can be obtained.

Present looped fabrics, and more in particular cotton bath fabrics, have the disadvantage of considerably shrinking when being washed. The degree in which the terry shrinks depends or the construction of this terry cloth, the used yarns and the industrial finishing thereof. Also uniformity of the loops on the terry is an important aspect.

Another main disadvantage is that the loops, and in particular the loops of the terry, can easily be elongated, such that under normal circumstances of use of the cloths, problems with elongated loops will occur.

Some terry-cloths show a slower absorption of water, the colours of the fabrics in the terry can also change/bleach. Often, the use of the terry results in deformations and a consequence can be that the terry is drawn.

The present invention intends to provide an improved looped fabric and more in particular a terry which at least partially resolves the above-mentioned problems.

In particular, the present invention aims to provide a looped fabric having a more efficient water absorption capacity.

SUMMARY

For that, the present invention provides in a first aspect a looped fabric comprising a ground fabric made of cotton characterized in that the loop forming fibres are made of bamboo.

In a first embodiment, the invention provides a looped fabric that comprises a ground fabric that is essentially made of cotton and provided with loops of bamboo fibre.

In a second aspect, the present invention provides a terry that is formed from a looped fabric according to the present invention.

The invention further concerns the use of bamboo fibre, and preferably comprised between 30% to 100% bamboo fibre, in a looped fabric, for instance for a terry such as a towel, bathrobe or the like.

The present invention, in particular the fact that the loops of the looped fabric are made of bamboo yarns, offers different advantages compared to looped fabrics known in the prior art.

In particular, the use of bamboo fibres on a cotton ground fabric provides a better water absorbing capacity to the looped fabric and the cloths made therefrom. The water absorbing capacity of the looped fabrics and the cloths made there from is up to 50% better than the capacity of fabrics and known cloths which are made of cotton. The looped fabric has in particular the additional characteristic to be able to immediately absorb water. In addition, the looped fabrics according to the present invention are also able to absorb a sufficient amount of water in order to be functional and to rapidly dry once they have taken up water.

Furthermore, bamboo has natural anti-bacterial characteristics. As a consequence, the use of bamboo fibres in looped fabrics and terry cloths is very advantageous from a hygienic point of view. In view of these anti-bacterial characteristics, the looped fabric according to the invention can be advantageously used for the manufacture of (medical) clothing, (medical) bandage, (medical) stuffing, gauze and the like.

Another advantage regards the lightness of the present looped fabric, which is pleasant to wear: it is cool in the summer, especially when wearing closely fitting clothes.

Another advantage of a looped fabric according to the present invention is an improved softness of the tissue. Although softness is a very subjective technical feature which is difficult to describe technically, the looped fabric according to the present invention feels softer compared to known corresponding fabrics.

Another advantage of a present looped fabric is that by applying bamboo fibres, a fabric can be obtained that has a natural appearance. The "silky" brilliance which is obtained in the present looped fabrics has an aesthetic advantage in addition to the colours and the general aspect of the fabric or cloth. Terry cloths can be manufactured by means of sponge fabrics according to the current invention. Such terry cloths can comprise of a combination of looped fabric with a border, optionally having a woven illustration. Such terry cloths provide a calming texture, and give the cloths a luxurious cachet, which is further emphasized by a discrete illustration woven in the border, for example, a bamboo figure.

The looped fabric according to the present invention is characterized by a number of technical parameters such as compactness (weft threads per cm), used yarns counts (thickness of the yarns), weight, loop length, etc. . . . Such parameters are chosen and composed in such a way that a pleasant cloth is obtained which complies with above-mentioned characteristics. The technical parameters of a looped fabric according to the present invention are discussed in more detail below.

Additional features and examples of looped fabrics according to the present invention are discussed below in a non-limitative way.

DETAILED DESCRIPTION OF THE FIGURES

FIG. 1 represents a perspective view of a looped fabric that is suitable for use in terry, e.g. in a bath towel.

FIG. 2 represents schematically in section and on chequered paper four basic effects of terry having two colours per warp unit. The figure is a schematic representation of a technique with three weft sequences. The ground warp is not represented.

FIG. 3A-G represent schematically seven basic effects of terry having two colours per warp unit.

DETAILED DESCRIPTION

Figure 1:
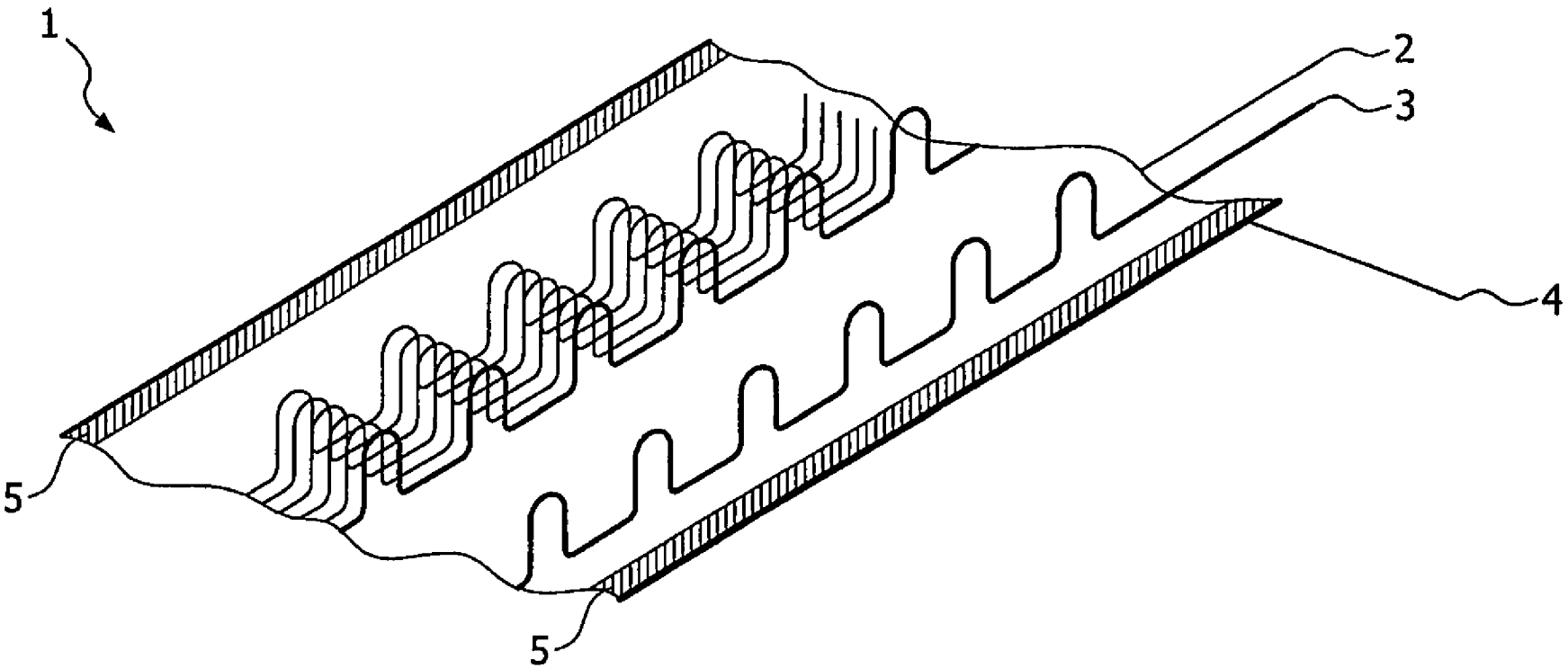

The present invention relates to an improved looped fabric. The terms "looped fabric", "sponge fabric" or "looped tissue" are used herein as synonyms and refer to a fabric that essentially consists of a ground fabric from which loops extend on one or both sides of the ground fabric.

The terms "fibre" or "yarn" are used herein as synonyms.

In a first embodiment, the present invention provides a looped fabric that comprises a ground fabric which is essentially made of cotton and provided with loops of bamboo fibre. The bamboo fibres can be formed by a warp or by a weft, and preferably by a warp.

Bamboo fibre can be compared with a regenerated cellulose fibre that is made from bamboo pulp. First the pulp can be purified via a process including hydrolysis under alkali conditions and a bleaching process showing multiple phases. Subsequently, the pulp is transformed to fibre. Physical parameters of a preferred embodiment of a bamboo fibre are provided hereunder in table 1. The represented values can vary by 20%.

TABLE 1

Physical parameters of a preferred embodiment of a bamboo fibre (Test conditions: Temperature: 20° C.; Relative humidity: 65%)

| | |
|---|---|
| Dry tensile strength(CN/dtex) | 2.33 |
| Wet tensile strength (CN/dtex) | 1.37 |
| Dry elongation at break (%) | 23.8 |
| Linear density percentage of deviation (%) | −1.8 |
| Percentage of length deviation (%) | −1.8 |
| Overlength staple fibre (%) | 0.2 |
| Overcut fiber (mg/100 g) | 6.2 |
| Maximale Residuele Sulphur (mg/100 g) | 9.2 |

TABLE 1-continued

Physical parameters of a preferred embodiment of a bamboo fibre (Test conditions: Temperature: 20° C.; Relative humidity: 65%)

| | |
|---|---|
| Defect (mg/100 g) | 6.4 |
| Oil-stained fibre (mg/100 g) | 0 |
| Coefficient of dry tenacity variation (CV)(%) | 13.42 |
| Whiteness (%) | 69.6 |
| Oil content (%) | 0.17 |
| Moisture regain (%) | 13.03 |

In a preferred embodiment the looped fabric is characterized in that bamboo loops are formed on both sides of the ground fabric. For special applications, it is possible to provide bamboo loops on only one side of the ground fabric.

In another preferred embodiment the bamboo fibre is completely or partly mixed with other fibres, such as e.g. cotton, polyester, viscose, etc. . . .

In a particularly preferred embodiment, the invention provides a looped fabric comprising a ground warp, a looped warp and a ground weft, woven or knitted. The ground weft, the ground warp and the looped warp may comprise simple yarns and/or twined yarns. Yarns that are twisted are called twined yarns. The term "twined" should be understood in its broadest context and comprises for instance also simple twisting of the yarns. The yarn may be twined in the S- or Z-direction. The bamboo yarn may be a simple or a twined yarn. Mixing with other fibres may be done for simple as well as for wined yarns.

In another embodiment the yarns in the ground warp and/or the looped warp are sheared. In another embodiment, the loop may be sheared (wounded), such that a velvet surface is obtained.

In a particularly preferred embodiment, the invention provides a looped fabric comprising a ground warp which preferably is made of cotton, and preferably 100% cotton, whereby a strong thread is preferred. In the ground warp, simple as well as twined yarns may be used. In another embodiment the looped fabric according to the invention comprises a ground warp and ground weft made of cotton, and preferably 100% cotton.

The looped warp preferably essentially consists of bamboo fibre and preferably of 30 to 100% bamboo fibre. Optionally the bamboo fibre can be mixed completely or partly with other fibres. In the looped warp, simple as well as twined yarns may be used. The looped warp preferably shows a weak torsion to improve water absorbance. For simple yarns, the term "weak torsion" refers to an alpha angle which is lower than 4.3. The "alpha" is a theoretical slope angle of the fibres versus the length direction of the yarn. For twined yarns, the term "weak torsion" refers to a twine torsion which is lower than 7.5 tpi (turns per inch).

In another embodiment, a looped fabric may be provided wherein ground warp and looped warp essentially consist of bamboo fibre, and preferably of 30 to 100% bamboo fibre. In yet another embodiment, a looped fabric may be provided wherein ground warp, looped warp and ground weft essentially consist of bamboo fibre, and preferably of 30 to 100% bamboo fibre. Bath towels are also possible according to the invention wherein the warp consists of bamboo fibre (preferably from 30 to 100% bamboo fibre) and of simple yarn. This further improves the flexibility, but these towels will be woven with a long loop, and this gives a specific fabric pattern.

In an embodiment, the invention provides a looped fabric having a ground warp and looped warp which are evenly sheared or sheared thread by thread; and a ground weft comprising simple or twined yarns.

In a particularly preferred embodiment the invention provides a looped fabric comprising:

- a ground warp, preferably of 100% cotton, whereby a strong thread is preferred; this ground warp can also preferably be evenly sheared;
- a looped warp, preferably of 100% bamboo, eventually completely or partly mixed with other fibres, having preferably a weak torsion to improve water absorbance. Preferably, the bamboo looped warp is sheared thread by thread, e.g. with one thread colour a, another thread colour b, etc., form a total number of weft threads with their corresponding colour pattern, and
- a ground weft, which preferably consists of simple yarns and also preferably of 100% cotton.

In another embodiment, the bamboo looped warp may have one or more colours. To obtain even terry, the bamboo looped warp may be provided in one colour. Colours of weft threads, ground warp and looped warp may be the same or different. Some terry may be woven extra heavily, e.g. for a bathroom carpet. It is also possible to knit bamboo fibres.

The fabrics according to the invention may by optimized in strength in the length as well as in the width direction.

The looped fabric according to the invention is characterised by below given technical parameters.

The looped fabric has a weight comprised between 200 and 1700 gram/m$^2$ and preferably between 300 and 850 gram/m$^2$.

The looped fabric according to the invention comprises a number of threads the per cm fabric in the warp direction comprised between 21 and 34 and preferably between 21 and 29. In another embodiment the invention provides a looped fabric wherein the number of weft threads per cm fabric is comprised between 10 and 28, and preferably between 14 and 22.

The loop length per loop (and thus also the height H of a loop) is essentially defined by the ratio between the cm loop warp per cm of ground fabric and the number of loops per cm. The number of loops per cm is preferably determined by dividing the number of weft threads per cm by 3 (for a technique with three weft sequences) or by 4 (for a technique with four weft sequences). In a preferred embodiment the number of loops per cm looped fabric according to the invention is comprised between 3 and 9, and preferably between 4 and 7. In another embodiment the looped fabric is characterized in that the loop length per cm fabric on one side of the fabric is comprised between 0.5 and 1.7 cm, and preferably between 0.7 and 1.5 cm. In another embodiment the looped fabric is characterised in that the bamboo loops extend from the ground fabric to a height H, and at the height H/2 a width B, whereby B is $\leqq$⅔H. All loops in the fabric may have a same loop length/loop height. It is also possible to apply different loop lengths/loop heights in the fabric. For instance; the loops on one side of the fabric may have different characteristics, and in particular may have a different loop length/loop height, than the loops at the other side of the fabric. Also, loops having different loop lengths/loop heights may be applied on one side of the fabric. For instance, a second loop height may be applied.

In another embodiment the looped fabric is characterized in that more than 30%, for instance more than 50%, for instance more than 75%, for instance more than 85%, for instance more than 95% of the surface of the looped fabric is covered with bamboo loops. In another embodiment, the looped fabric is characterized in that between 30 and 90%, and preferably 60% of the total weight of the looped fabric consists of bamboo loops.

In a preferred embodiment the invention comprises a looped fabric wherein the yarn count in the looped warp is comprised between Ne 3/1 and Ne 40/1 and for instance between Ne 12/1 and Ne 24/1 for simple yarns and between Ne 8/2 and Ne 40/2, and for instance between Ne 12/2 and Ne 36/2 for twined yarns. In another preferred embodiment the invention comprises a looped fabric wherein the yarn count in the ground warp is comprised between Ne 6/1 and Ne 20/1 for simple yarns and between Ne 12/2 and 30/2 for twined yarns. In another preferred embodiment the invention comprises a looped fabric wherein the yarn count in the ground weft comprises between Ne 10/1 and Ne 24/1 for simple yarns.

Referring to FIG. 1, a perspective view of a looped fabric 1 is represented which is suitable for being used in terry cloth, for instance for a bath towel. The fabric 1 comprises a ground warp 2, a looped warp 3 and a ground weft 4. We can point out different possibilities of thread distribution, in particular: cotton or bamboo ground warp and bamboo looped warp which are arranged per thread; or cotton or bamboo ground warp and bamboo looped warp which are arranged per two threads; or cotton or bamboo ground warp which is arranged per two threads and bamboo looped warp which is arranged per thread; or cotton or bamboo ground warp which is arranged per thread and bamboo looped warp which is arranged per two threads. Conditions for obtaining a successful bamboo loop formation include: a) the weave should be correctly applied, and the loop forming apparatus should work in correct phase with the weave, b) the tension of looped and ground warp should be optimal and c) the yarn counts in warp and weft should be correct. Furthermore, the warp loom needs to be closely adjusted, especially with regard to the aperture and the functioning of the temples.

Referring to FIG. 2 four basic effects of terry having two colours per warp unit are represented. A bath towel according to the invention is preferably manufactured with thread by thread shearing of the loop threads; i.e. two colours of looped warp (A and B), sheared one thread colour A and one thread colour B. Two loop threads are combined to one warp unit and using such unit four basic effects may be obtained, which can eventually be extended to seven (see FIG. 3) depending on the equipment of the weaving machine. The four basic effects can be extended by another three effects: no loops at both sides; fringes; or application of a second loop height.

Figures 2A, 2B, 2C, 2D:
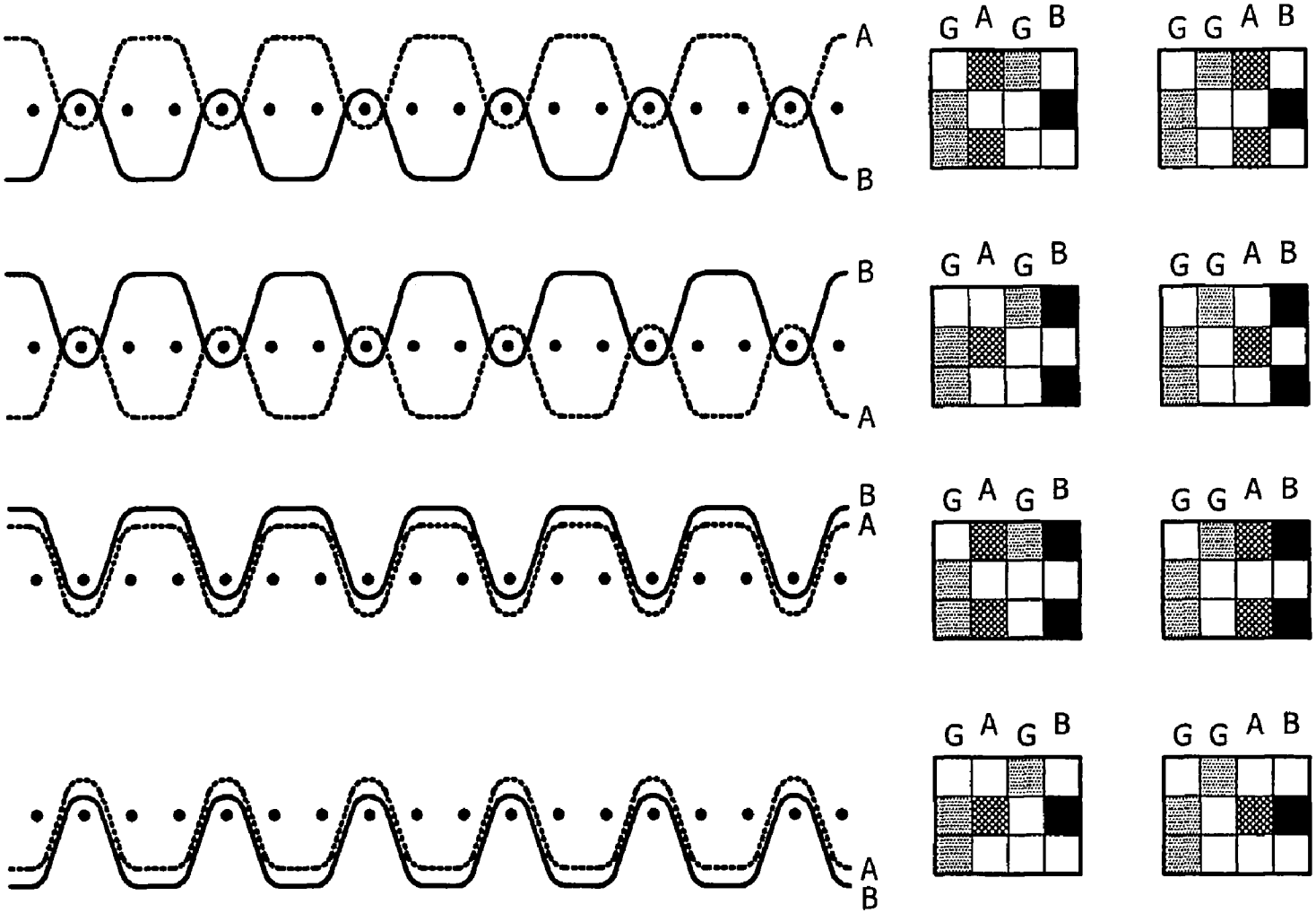
Figures 3A, 3B, 3C, 3D, 3E, 3F:
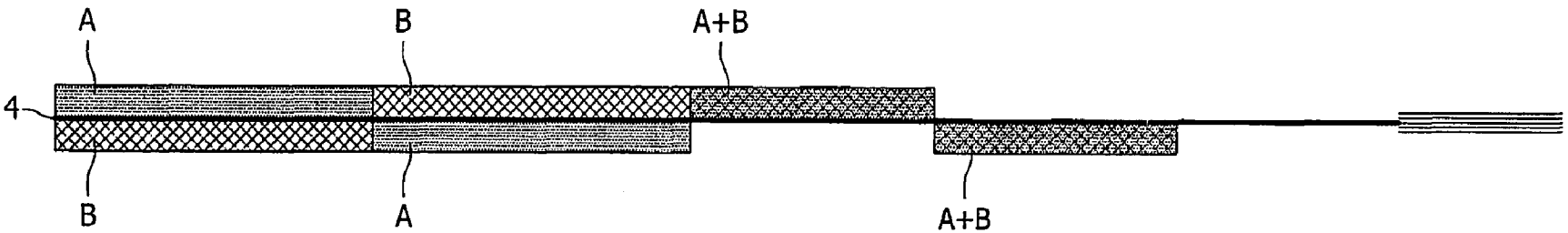
Figure 3G:
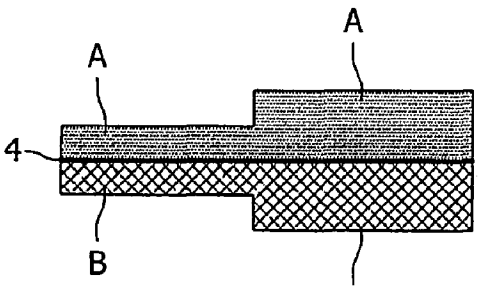

The effect in FIGS. 2*a* and 3*a* comprises loops with colour A at the upper side and loops with colour B at the lower side. The effect in FIGS. 2*b* and 3*b* comprises loops with colour B at the upper side and loops with colour A at the lower side. The effect in FIGS. 2*c* and 3*c* comprises loops with colour A and B at the upper side and no loops at the lower side. The effect in FIGS. 2*d* and 3*d* comprises loops with colour A and B at the lower side and no loops at the upper side. The effect in FIG. 3*e* comprises no loops at the upper or lower side. The effect in FIG. 3*f* comprises fringes (whereby the warps are drawn). The effect in FIG. 3*g* comprises the application of a second loop height. The effects in e, f and g can be applied over the total width of the fabric.

Figure 4:
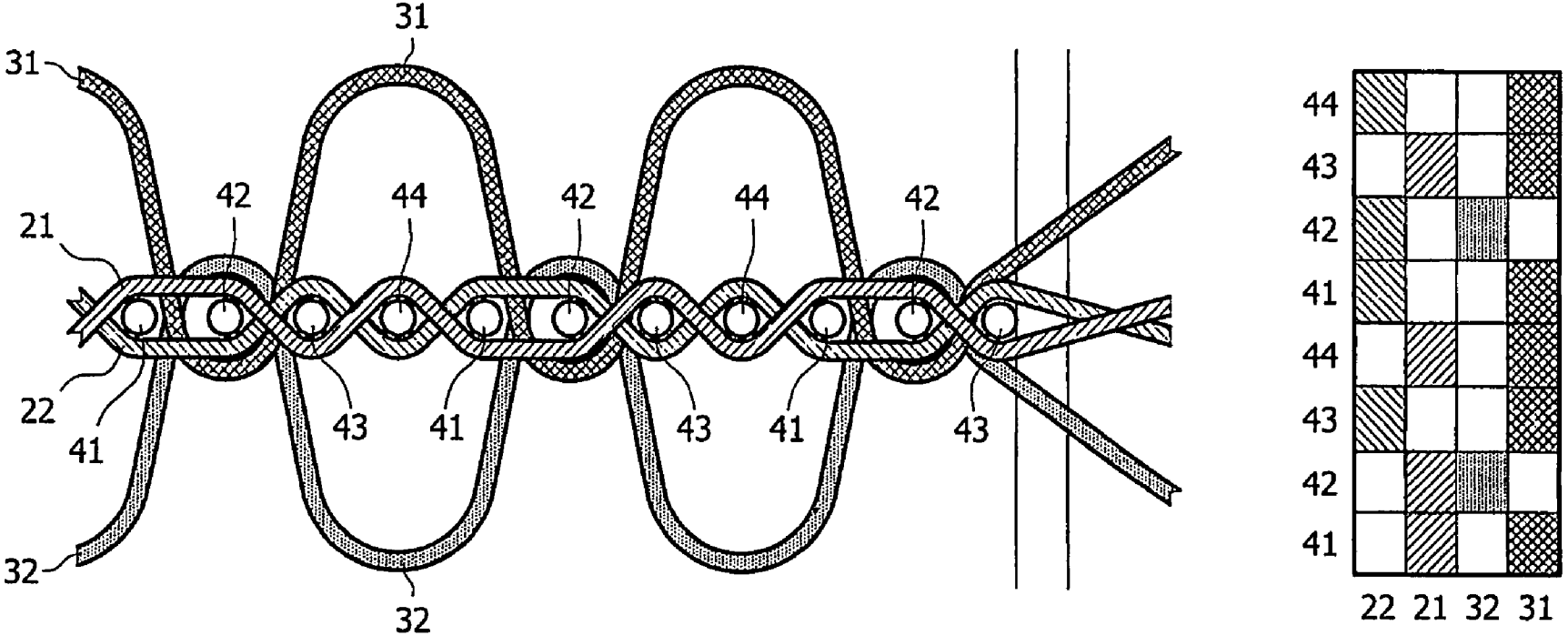
FIG. 4 represents schematically in section and on chequered paper a technique with four weft sequences having a ground weave of 2-1-1.
Figure 5:
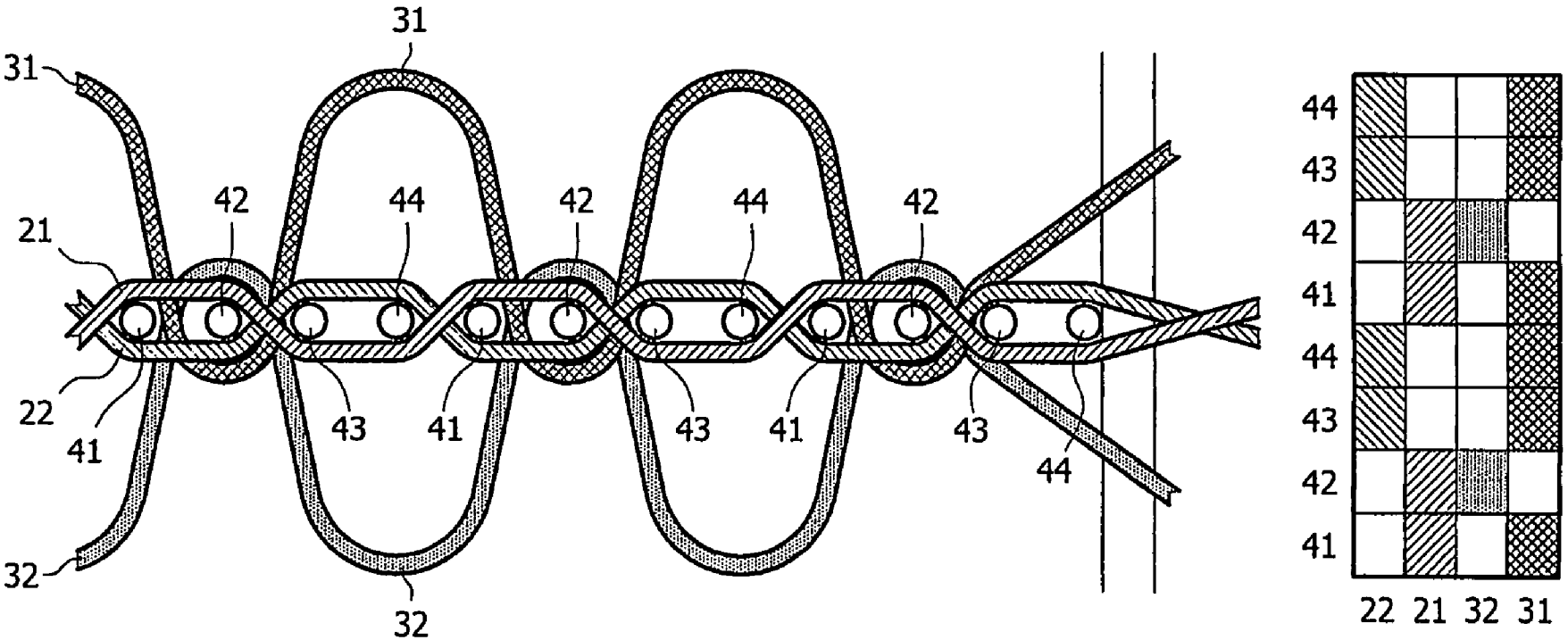
FIG. 5 represents schematically in section and on chequered paper a technique with four weft sequences having a ground weave of 2-2.

FIG. 4 represents schematically in section and on chequered paper a technique with four weft sequences having a ground weave of 2-1-1. FIG. 5 represents schematically in section and on chequered paper a technique with four weft sequences having a ground weave of 2-2. The fabrics comprise two loop warp threads 31, 32 of 100% bamboo fibre; four weft threads 41, 42, 43, 44 of 100% cotton and two ground warp threads 21, 22 of 100% cotton or of 100% bamboo.

The looped fabric according to the present invention can be applied in different application including terry and the like, for instance in towels, bathrobes, bath capes, face clothes; sleeping bags made of terry, etc. . . . The looped fabric according to the present invention can also be used for clothing including for (baby) clothes, medical clothes, and sport and pleasure clothes etc. For this, one can use knitted terry cloth or a heavily woven format. Other application possibilities for the looped fabric according to the invention include use in bandages, gauzes, (baby) clothes, medical clothing, sport and pleasure clothes, bedding materials, blankets, mats, carpets, and the like.

In a preferred embodiment the invention provides a terry which comprises a looped fabric according to the invention, and which is preferably also provided with one or more borders (see e.g. borders 5 represented on FIG. 1). Such borders may be optionally provided with a fantasy illustration. A lot of bath towels have borders wherein fantasy illustrations are inserted. These borders may also be provided in bamboo fibre. Such border may substantially be made of bamboo fibre, and preferably of 30% to 100% bamboo fibre. In a preferred embodiment, such terry has a border having a length comprised between 1 and 15 cm, and preferably between 5 and 10 cm.

EXAMPLE

In an example a sponge fabric according to the invention is illustrated having 28 weft threads per cm. preferably the used yarns in the looped warp are Ne 16/1 and are 100% bamboo yarns. In the ground warp, the used yarns preferably are Ne 12/1 and also preferably also in the ground weft Ne 16/1. The weight of the cloth is comprised between 450 and 700 gram/$m^2$, and preferably comprises about 600 gram/$m^2$. The loop length comprises preferably between 1.0 and 1.4 cm and most preferably about 1.2 cm. This allows obtaining a preferred cloth which satisfies the expectations of a customer regarding loop consistency, water absorption, touch, flexibility, brilliance.

What is claimed is:

1. A looped fabric comprising a ground fabric consisting essentially of cotton and provided with loops consisting essentially of bamboo fiber, whereby said ground fabric is provided with a ground weave that is obtained by a technique with three weft sequences or by a technique with four weft sequences, whereby said looped fabric has a weight between 200 and 1700 gram/$m^2$, and whereby the number of warp threads per cm fabric is between 21 and 34, the number of weft threads per cm fabric is between 10 and 28, and the number of loops per cm fabric is between 3 and 9.

2. The looped fabric according to claim 1, wherein the bamboo loops are formed by a warp.

3. The looped fabric according to claim 1, wherein the bamboo loops are formed by a weft.

4. The looped fabric according to claim 1, wherein the bamboo loops are provided at both sides of the ground fabric.

5. The looped fabric according to claim 1, wherein the bamboo fiber is completely or partly mixed with other fibers.

6. The looped fabric according to claim 1, comprising a ground warp, a looped warp and a ground weft.

7. The looped fabric according to claim 6, wherein the ground weft, the ground warp and the looped warp comprise simple yarns or twined yarns.

8. The looped fabric according to claim 6, wherein the yarns in the ground warp and/or the looped warp are sheared.

9. The looped fabric according to claim 6, wherein the ground warp and the ground weft consist of cotton.

10. The looped fabric according to claim 6, wherein the looped warp consists of bamboo fiber.

11. The looped fabric according to claim 6, wherein the ground warp and the looped warp consist essentially of bamboo fiber.

12. The looped fabric according to claim 1, comprising a ground warp and a looped warp which are sheared evenly or thread per thread and a ground weft consisting of simple yarn or twined yarn.

13. The looped fabric according to claim 1, wherein the fabric comprises a loop length per cm fabric on one side of the fabric that is between 0.5 and 1.7 cm.

14. The looped fabric according to claim 1, wherein the bamboo loops extend from the ground fabric to a height H, and the bamboo loops have, at the height H/2, a width B which is $\leqq$⅔ H.

15. The looped fabric according to claim 1, wherein more than 30% of the surface of the looped fabric is covered with bamboo loops.

16. The looped fabric according to claim 1, wherein between 30 and 90% of the total weight of the looped fabric consists of bamboo loops.

17. The looped fabric according to claim 6, whereby the yarn count in the looped warp is between Ne 3/1 and Ne 40/1 for simple yarns and between Ne 8/2 and Ne 40/2 for twined yarns.

18. The looped fabric according to claim 6, whereby the yarn count in the ground warp is between Ne 6/1 and Ne 20/1 for simple yarns and between Ne 12/2 and Ne 30/2 for twined yarns.

19. The looped fabric according to claim 6, whereby the yarn count in the ground weft is between Ne 10/1 and Ne 241 for simple yarns.

20. The looped fabric according to claim 1, wherein the applied bamboo fiber has at least one of the physical characteristics at a temperature of 20° C. and relative humidity of 65% within 20% variance selected from the following: 2.33 CN/dtex dry tensile strength, 1.37 CN/dtex wet tensile strength, 23.8% dry elongation at break, −1.8% linear density percentage of deviation, −1.8% percentage of length deviation, 0.2% overlength staple fibre, 6.2 mg/100 g overcut fiber, 9.2 mg/100 g maximal residual sulphur, 6.4 mg/100 g defect, 0 mg/100 g oil-stained fibre, 13.42% CV coefficient of dry tenacity variation, 69.6% whiteness, 0.17% oil content, and 13.03% moisture regain.

21. A terry made from a looped fabric comprising a ground fabric consisting essentially of cotton and provided with loops consisting essentially of bamboo fiber, whereby said ground fabric is provided with a ground weave that is obtained by a technique with three weft sequences or by a technique with four weft sequences, whereby said looped fabric has a weight between 200 and 1700 gram/$m^2$, and whereby the number of warp threads per cm fabric is between 21 and 34, the number of weft threads per cm fabric is between 10 and 28, and the number of loops per cm fabric is between 3 and 9.

22. The terry according to claim 21, wherein the terry is provided with one or more borders that consist essentially of bamboo fiber, and that is optionally provided with a fantasy illustration.

23. The terry according to claim 22, wherein the border has a length between 1 and 15 cm.

* * * * *

UNITED STATES PATENT AND TRADEMARK OFFICE

CERTIFICATE OF CORRECTION

PATENT NO. : 7,543,608 B2
APPLICATION NO. : 10/584964
DATED : June 9, 2009
INVENTOR(S) : Frédéric Santens It is certified that error appears in the above-identified patent and that said Letters Patent is hereby corrected as shown below:

Column 5, Line 51, "whereby B is ≦ ⅔H." should be changed to --whereby B is ≦ 2/3 H.--

Column 8, Line 33, "Ne 10/1 and Ne241" should be changed to --Ne 10/1 and Ne 24/1--

Column 8, Line 43, "maximal residual sulphur," should be changed to --maximale residuele sulphur,--

Signed and Sealed this

Eighth Day of December, 2009

David J. Kappos

David J. Kappos
*Director of the United States Patent and Trademark Office*